US005322495A

United States Patent [19]

Budjinski, II et al.

[11] Patent Number: 5,322,495

[45] Date of Patent: Jun. 21, 1994

[54] HIGH SPEED VACUUM ASSISTED FREE FLOWING MATERIAL INSERTER IN FILTER ROD MANUFACTURE

[75] Inventors: Joseph F. Budjinski, II, Quinton; Charles G. Atwell, Mechanicsville; Larry E. Stevens, Chesterfield; Martin T. Garthaffner, Midlothian; Billy J. Keen, Jr., Chesterfield; Grier S. Fleischhauer, Midlothian, all of Va.

[73] Assignee: Philip Morris Incorporated, New York, N.Y.

[21] Appl. No.: 34,085

[22] Filed: Mar. 22, 1993

Related U.S. Application Data

[63] Continuation of Ser. No. 874,542, Apr. 27, 1992, Pat. No. 5,221,247.

[51] Int. Cl.[5] ..... A24D 3/02

[52] U.S. Cl. ..... 493/48; 493/44

[58] Field of Search ..... 493/42, 44, 47, 48

[56] References Cited

U.S. PATENT DOCUMENTS

| | | | |
|---|---|---|---|
| 3,312,151 | 4/1967 | Molins | 93/1 |
| 3,340,775 | 9/1967 | Raymond et al. | 93/1 |
| 3,348,455 | 10/1967 | Williamson et al. | 93/1 |
| 3,550,508 | 12/1970 | Wartman et al. | 93/1 |
| 3,570,557 | 3/1971 | Molins | 141/99 |
| 3,623,404 | 11/1971 | Jackson | 493/48 |
| 3,625,118 | 12/1971 | Jackson | 93/1 |
| 3,807,286 | 4/1974 | Sexstone | 93/1 |
| 3,844,200 | 10/1974 | Sexstone | 93/1 |
| 3,884,741 | 5/1975 | Sexstone | 156/259 |
| 3,943,832 | 3/1976 | Sexstone | 93/1 |
| 3,957,563 | 5/1976 | Sexstone | 156/438 |
| 4,005,668 | 2/1977 | Washington et al. | 141/67 |
| 4,016,830 | 4/1977 | Sexstone | 118/406 |
| 4,090,424 | 5/1978 | Hall | 83/330 |
| 4,174,720 | 11/1979 | Hall | 131/90 |
| 4,184,412 | 1/1980 | Hall | 93/1 |
| 4,208,956 | 6/1980 | Hall | 93/77 |
| 4,214,508 | 7/1980 | Washington | 93/1 |
| 4,412,829 | 11/1983 | Lebet et al. | 493/48 |
| 4,425,107 | 1/1984 | Hall | 493/48 |
| 4,861,324 | 8/1989 | Hirose et al. . | |

FOREIGN PATENT DOCUMENTS

| | | | |
|---|---|---|---|
| 1932607 | 12/1971 | Fed. Rep. of Germany | 493/48 |
| 1106931 | 3/1968 | United Kingdom | 493/48 |

*Primary Examiner*—William E. Terrell

*Attorney, Agent, or Firm*—Charles E. B. Glenn; James E. Schardt; Kevin B. Osborne

[57] ABSTRACT

This invention relates to a method for delivering free-flowing material into discrete receiving spaces separating filter plugs in partially constructed cigarette filter assemblies. The method entails rapidly feeding a free flowing material such as charcoal into partially constructed cigarette filter assemblies. The free flowing material is dispensed to a first conveyance means and is subsequently transferred to a second conveyance means that is positioned parallel and above the first conveyance means. Vacuum is used to hold the free flowing particulate material onto the first conveyance means and is used to transfer the free flowing material to the second conveyance means and to hold it there. The free flowing material is next transferred into receiving spaces formed between articles such as cigarette filter plugs that are disposed on a third conveyance means. The transfer of the free flowing material to the receiving spaces may also be accomplished by use of vacuum or gravity.

14 Claims, 16 Drawing Sheets

HIGH SPEED VACUUM ASSISTED FREE FLOWING MATERIAL INSERTER IN FILTER ROD MANUFACTURE

CROSS REFERENCE TO RELATED APPLICATION

This application is a continuation of copending, commonly-assigned U.S. patent application Ser. No. 07/874,542 filed Apr. 27, 1992, now U.S. Pat. No. 5,221,247 which is hereby incorporated by reference in its entirety.

BACKGROUND OF THE INVENTION

This invention relates to a method and device for use in the manufacture of cigarette filters. More particularly, this invention relates to a method and device for very high speed delivery of controlled amounts of a free-flowing material into discrete receiving spaces between individual filter plugs in partially-constructed cigarette filters. The device of this invention has a plurality of conveyance devices, each utilizing vacuum to rapidly and efficiently transfer and accurately place the free-flowing material into the discrete receiving spaces.

Some of the present devices used to transfer a free-flowing material into discrete spaces between filter plugs in cigarette filters are limited in operating speed due to the time required for the free-flowing material to free fall under the influence of gravity. For example, in Williamson, U.S. Pat. No. 3,312,152, powder is transferred from a hopper to a pocket under vacuum, but later, the powder free falls from that pocket into another pocket solely under the influence of gravity. Still later the powder again free falls from the later pocket into receiving spaces between filter plugs.

Other devices utilize vacuum but also are limited in the speeds they can operate due to the limited period of contact between a transferring receptacle and a receiving receptacle. For example, in Molins, U.S. Patent 3,312,151, powdered filter material is transferred from a hopper to pockets under vacuum, and then from the pockets to receiving spaces between the filter plugs under vacuum. However, each pocket only registers with the receiving space at one point. The wheel must rotate slowly enough to allow a suitable period of contact between the transferring pocket and the receiving space.

It would be desirable to replace the present devices with devices utilizing vacuum at all stages of the transfer of the free-flowing material. Vacuum facilitates transfer of free-flowing material at a much more rapid rate than gravity alone. It would likewise be desirable to replace the present devices with devices utilizing periods of parallel travel between the transferring receptacles and the receiving receptacles. Such parallel travel extends the period of contact between the receptacles, thus expanding the time available for transfer of the free-flowing material while still facilitating a very rapid process. Such use of vacuum and parallel travel would enable a device to deliver a free-flowing material at a much more rapid rate than present devices.

SUMMARY OF THE INVENTION

It is an object of this invention to provide a method and device for the delivery of controlled amounts of a free-flowing material into discrete receiving spaces in partially-constructed cigarette filters at a very high speed.

It is a further object to provide a method and device utilizing vacuum for the transfer of free-flowing material into receiving spaces between cigarette filter plugs.

It is a further object to provide a method and device utilizing periods of parallel travel of the transferring receptacles with respect to the receiving receptacles for the free-flowing material.

It is a further object to protect the filter plugs in the partially constructed cigarette filters from exposure to the free-flowing material.

These and other objects of this invention are accomplished by providing a method and device which includes parallel travelling vacuum-assisted conveyors and containers for transporting and placing controlled amounts of a free-flowing material into discrete receiving spaces between filter plugs with great speed and precision. The method and device of this invention may also include a screening tape to protect the filter plugs in the partially-constructed cigarette filters from exposure to the free-flowing material.

The device of this invention includes a metering device for dispensing a measured amount of a free-flowing material. The metering device may include a hopper to contain the free-flowing material and a cylindrical metering drum with recesses. Such a metering drum rotates beneath the hopper and the recesses trap measured amounts of the free-flowing material. The rotating metering drum then carries the free-flowing material to a point where it is released above a funnel. The funnel channels the free-flowing material to fall onto a rapidly moving transport tape located below the funnel.

The high speed transport tape or belt which receives the free-flowing material from the funnel is permeable to air. Vacuum applied beneath the transport tape draws the free-flowing material onto the surface of the tape, and holds it on the tape surface under vacuum. The transport tape then conveys the free-flowing material on a course parallel with and underneath a series of moving containers or pockets, each designed for receiving and holding a measured amount of free-flowing material.

Each pocket structure may contain an aperture which is divided by a screen into upper and lower portions. The pockets may be separate containers, each of which is attached to a continuous or endless belt which travels around a plurality of wheels oriented in the horizontal plane. Alternatively, the pockets may be containers directly piercing through and held within a continuous or endless belt which travels around a plurality of wheels oriented in the vertical plane. In either case, the continuous belt travels on a course that is, in part, parallel with and adjacent to the transport tape. During this period of parallel travel, the belt serves to position the pockets directly above the free-flowing material carried on the high speed transport tape.

At a point where the transport tape is traveling beneath the pockets, the vacuum applied to the tape ceases. Simultaneously, a vacuum hood directing vacuum through the apertures in the pockets engages. This vacuum serves to draw the free-flowing material off the transport tape and up into the lower portion of said pockets where measured amounts of the material are held in place. A screen in each pocket retains the free-flowing material in place and thus allows the applied vacuum to hold the free-flowing material in the pocket. Adjustment of the relative speed differences between the transport tape and the continuous belt carrying the pockets serves to significantly enhance the uptake of the free-flowing material by the pockets and results in essentially none of the free-flowing material remaining on the transport tape.

The continuous belt then carries the pockets, each containing a measured amount of free-flowing material held under vacuum, to a point where the belt begins a course parallel with and adjacent to a travelling garniture tape, such that the pockets are positioned over the garniture tape. The garniture tape travels through a trough called a garniture, and the garniture tape assumes the trough shape of the garniture. The garniture tape conveys a ribbon of filter plug wrap which also assumes the trough shape of the garniture. A series of filter plugs separated by discrete receiving spaces are axially aligned within this trough-shaped plug wrap. The garniture tape and the plug wrap it transports are both permeable to air.

At approximately the point where each pocket begins its travel above the garniture tape, each pocket also travels out from under a vacuum hood. As atmospheric pressure or slightly positive pressure applies to each pocket, the free-flowing material is released from the pocket. Depending on the distance between the garniture tape and the receiving space, a vacuum may be applied at this point to facilitate the release of free-flowing material, or gravity itself may be used. A continuous screening tape may be used which travels in the space between the filter plugs and the pockets. This screening tape may be used to mask the filter plugs from contact with the free-flowing material while openings in the screening tape allow passage of the free-flowing material into the discrete receiving spaces.

BRIEF DESCRIPTION OF THE DRAWINGS

The above and other objectives and advantages of the invention will be apparent upon consideration of the following detailed description, taken in conjunction with the accompanying drawings, in which like reference numerals refer to like parts throughout, and in which.

DETAILED DESCRIPTION OF THE EMBODIMENTS

Figure 1:
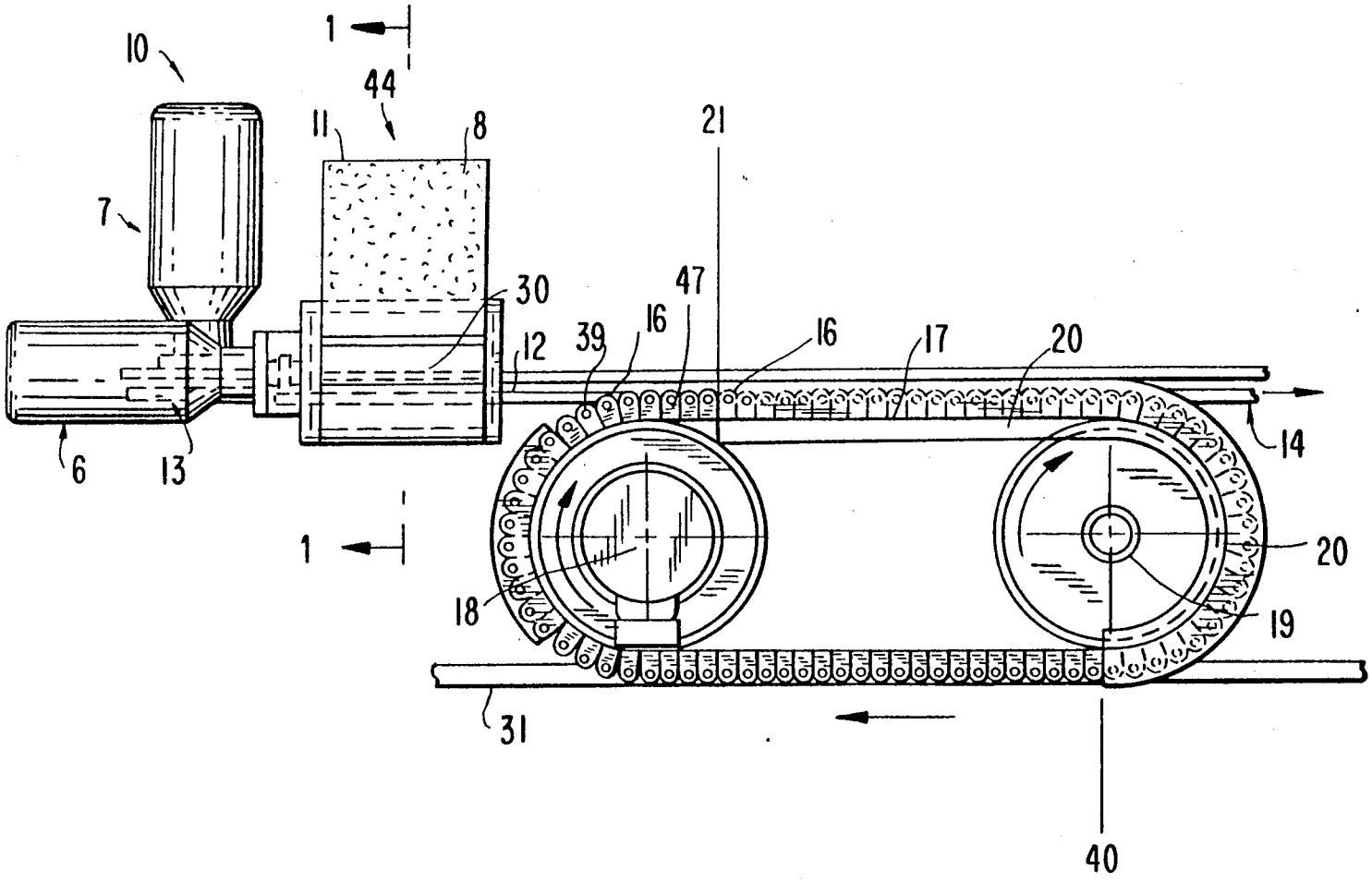
FIG. 1 is a top plan view of a preferred embodiment of the apparatus illustrating diagrammatically the basic relationship of several parts of the apparatus.
Figure 2:
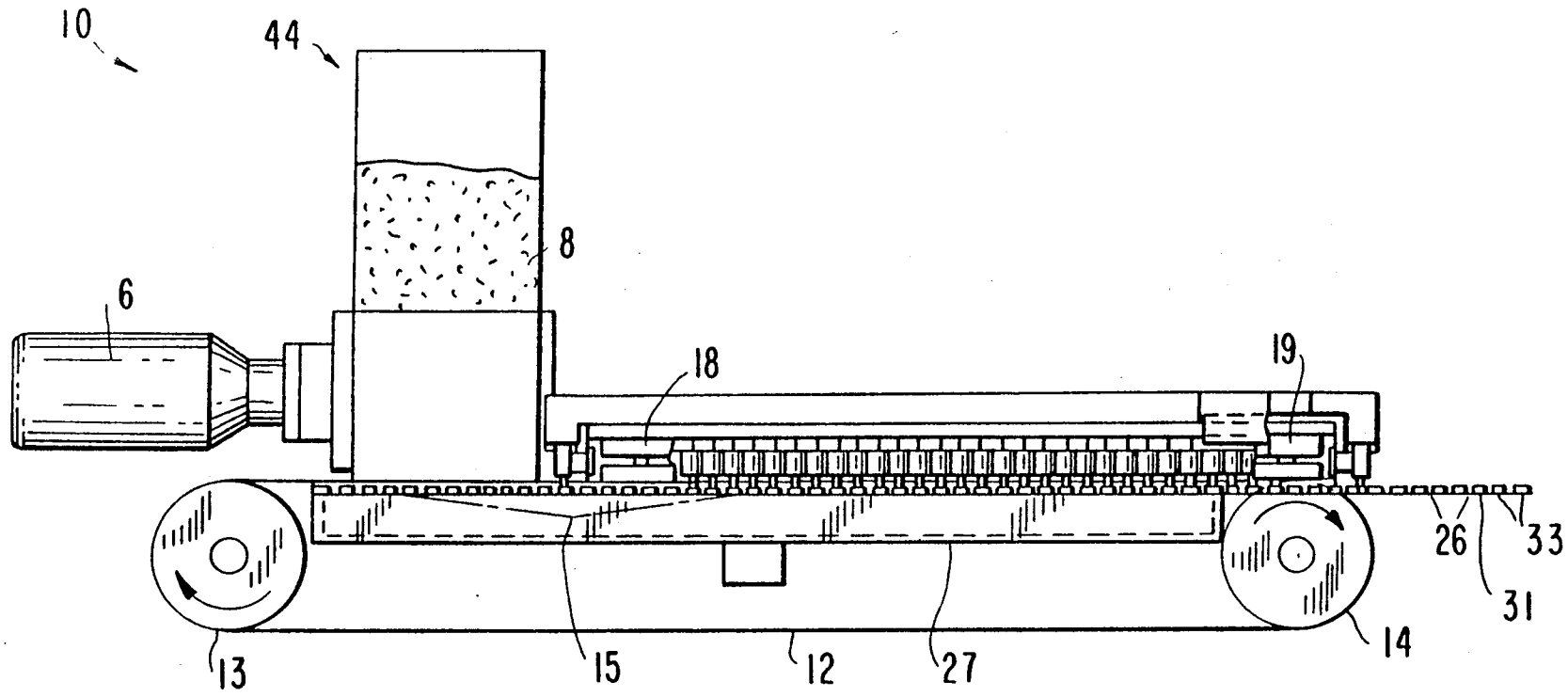
FIG. 2 is a full frontal view of the apparatus of FIG. 1.
Figure 3:
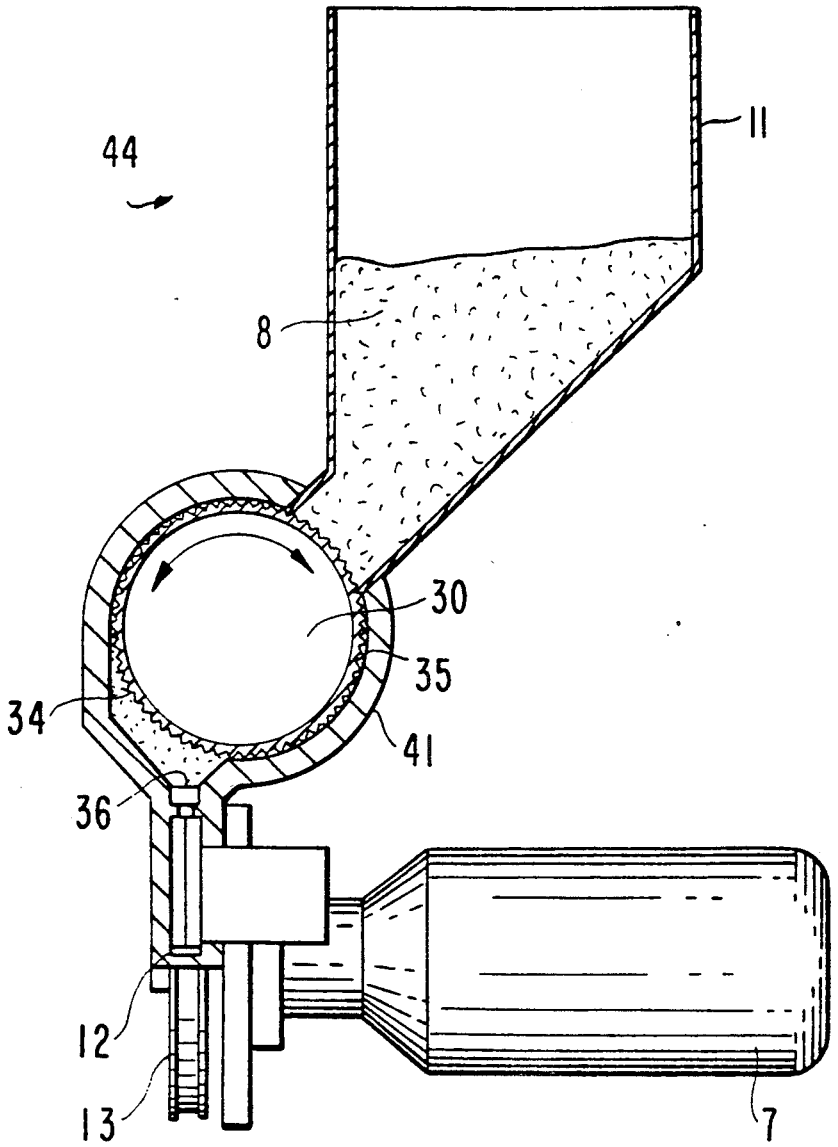
FIG. 3 is a sectional view of the apparatus of FIGS. 1-2, taken from line 1—1 of FIG. 1.

Referring to the drawings, FIGS. 1 and 2 illustrate a device designated generally by reference numeral 10. FIG. 3 is a cross-sectional view of the metering drum dispensing device 44 represented in FIGS. 1 and 2. Dispensing device 44 includes a free-flowing material hopper 11 which contains a free-flowing material 8, such as charcoal, a powder, a granulated material or some other free-flowing material. Dispensing device 44 also includes a cylindrical metering drum 30 that may be driven by an electric motor 6. Cylindrical metering drum 30 is provided with a series of recesses 34 running parallel to the axis of metering drum 30 and covering the outer circumferential surface of metering drum 30. As metering drum 30 turns, recesses 34 catch free-flowing material from the hopper 11 and transport it around the inner wall 35 of drum cover 41 so that the free-flowing material subsequently falls into funnel 36. Funnel 36 channels the free-flowing material onto transport tape 12. Varying the speed of rotation of metering drum 30 controls the amount of free-flowing material delivered to funnel 36. Metering drum 30 turns at sufficient speed to provide sufficient free-flowing material to funnel 36 so that this stage of operation of the device does not limit the overall speed of operation of device 10.

Transport tape 12 is an endless tape travelling around a plurality of wheels 13 and 14, aligned and positioned in the vertical plane. Wheels 13 and 14 function as spaced apart end sprockets providing drive, tension and position for tape 12. In the embodiment shown in FIGS. 1-3, wheel 13 is driven by an electric motor 7. Transport tape 12 is permeable to air but is impermeable to the free-flowing material. Vacuum from a vacuum chamber of plenum 15 located beneath transport tape 12 draws through the tape. This vacuum draws free-flowing material onto the surface of transport tape 12 and retains it in place, even as the tape moves at high speeds.

Figure 4:
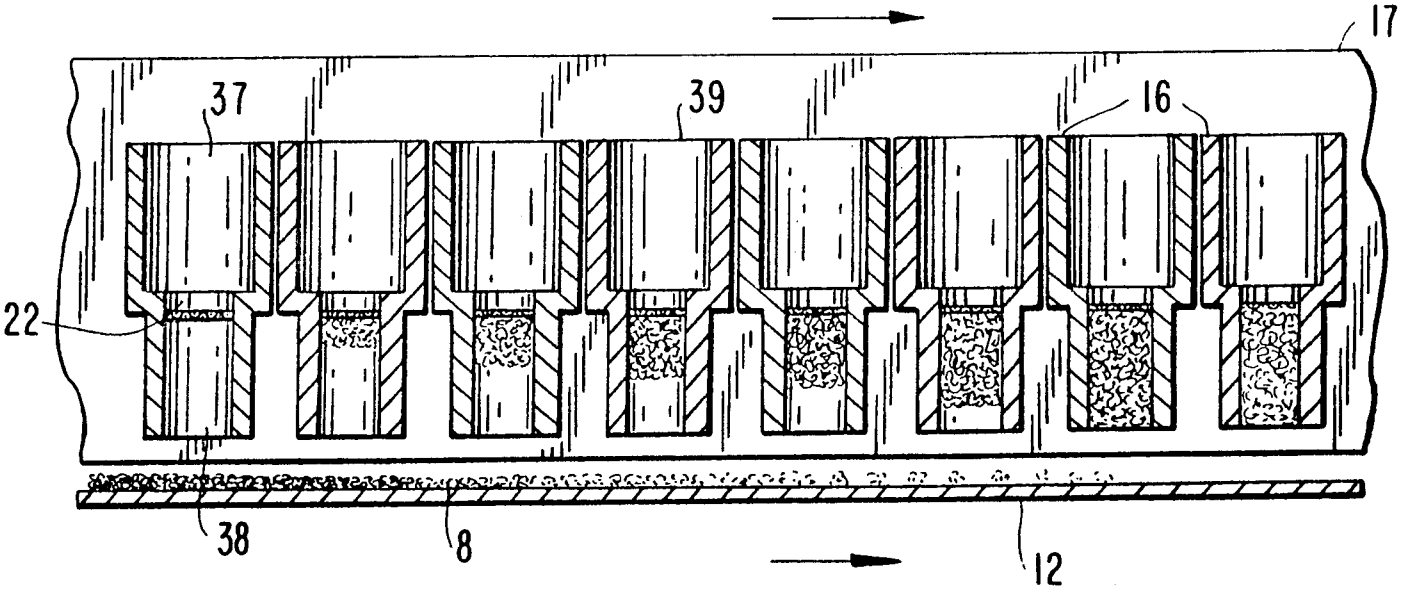
FIG. 4 is a cross-sectional view in fragmentary form of the apparatus of FIGS. 1-3, illustrating the basic relationship between the transport tape, the endless belt and the pockets.
Figure 5:
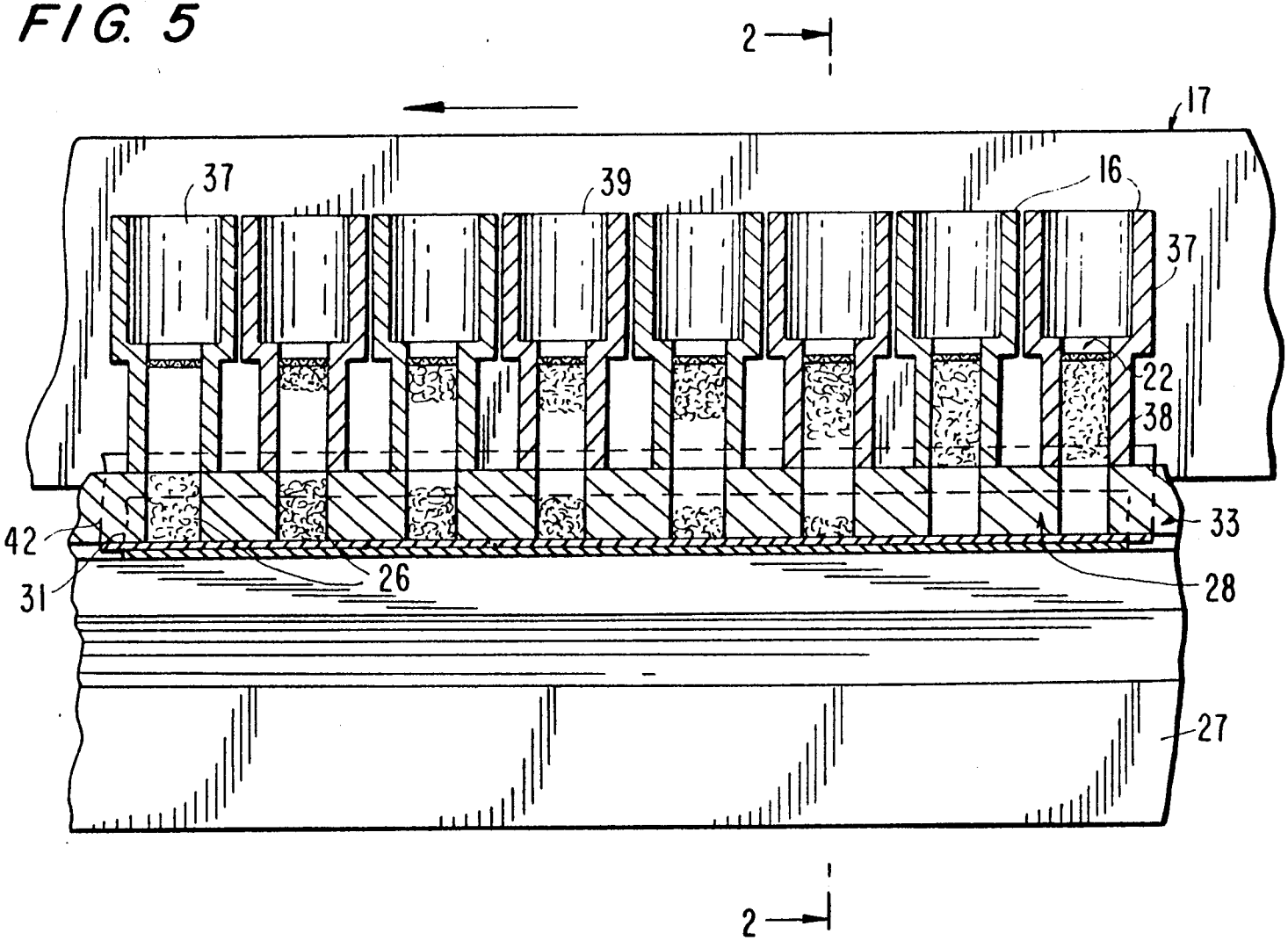
FIG. 5 is a cross-sectional view in fragmentary form of the apparatus of FIGS. 1-4, illustrating the basic relationship between the endless belt, the pockets, the garniture tape, the filter plug wrap and the garniture.
Figure 6:
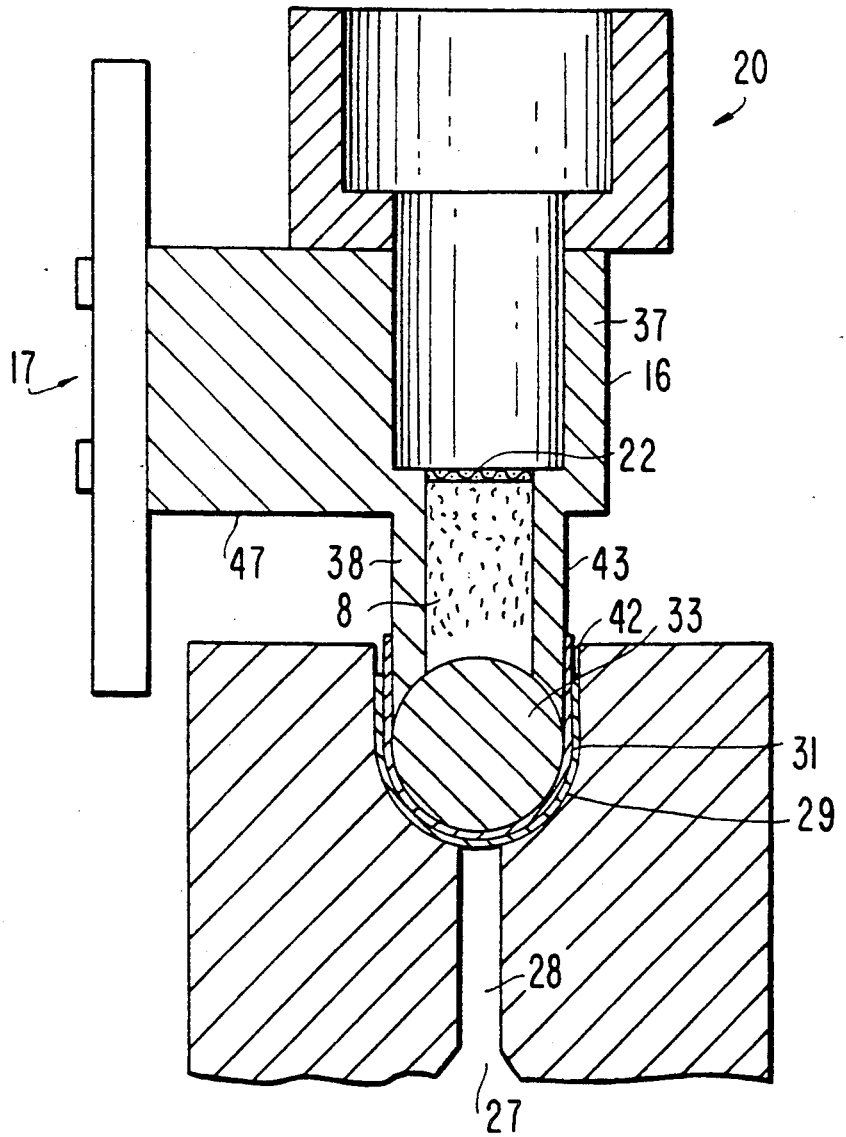
FIG. 6 is a sectional view of the apparatus of FIGS. 1-5, taken from line 2—2 of FIG. 5.
Figure 7:
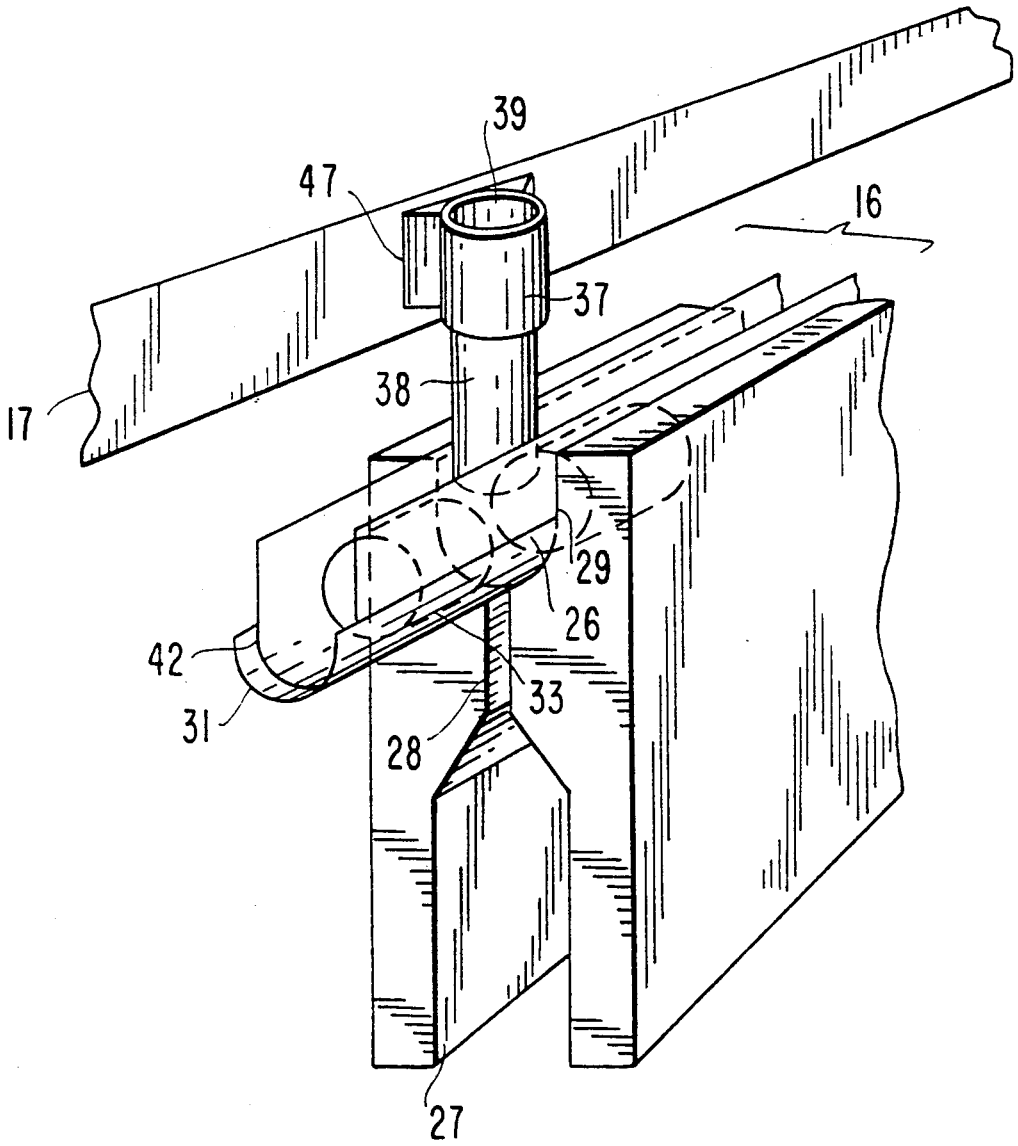
FIG. 7 is a perspective view in fragmentary form of the apparatus of FIGS. 1-6, illustrating the basic relationship between the endless belt, a pocket, the garniture tape, the filter wrap and the garniture.
Figure 8:
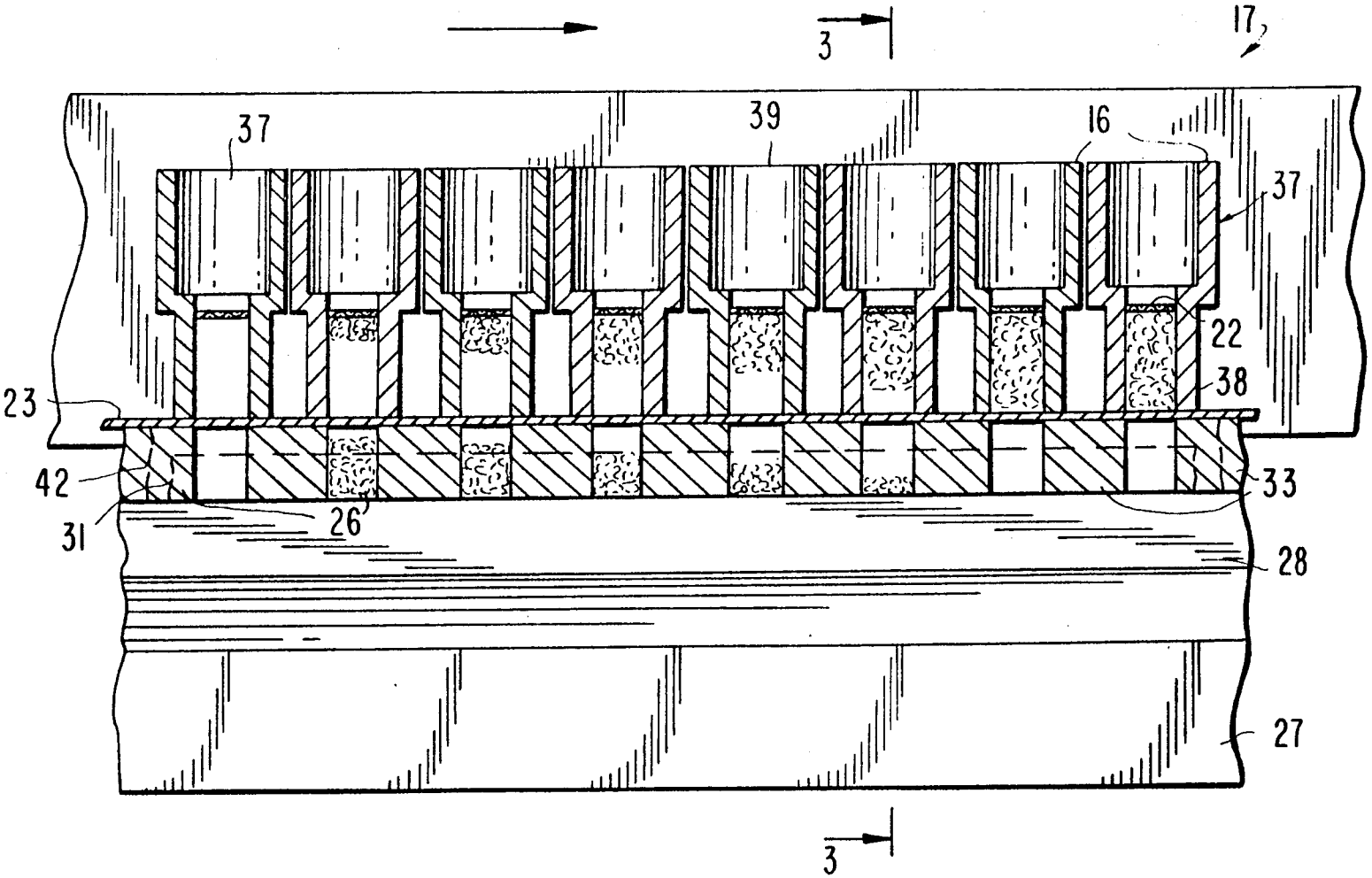
FIG. 8 is a cross-sectional view in fragmentary form, similar to FIG. 5, but of an embodiment with a screening belt.
Figure 9:
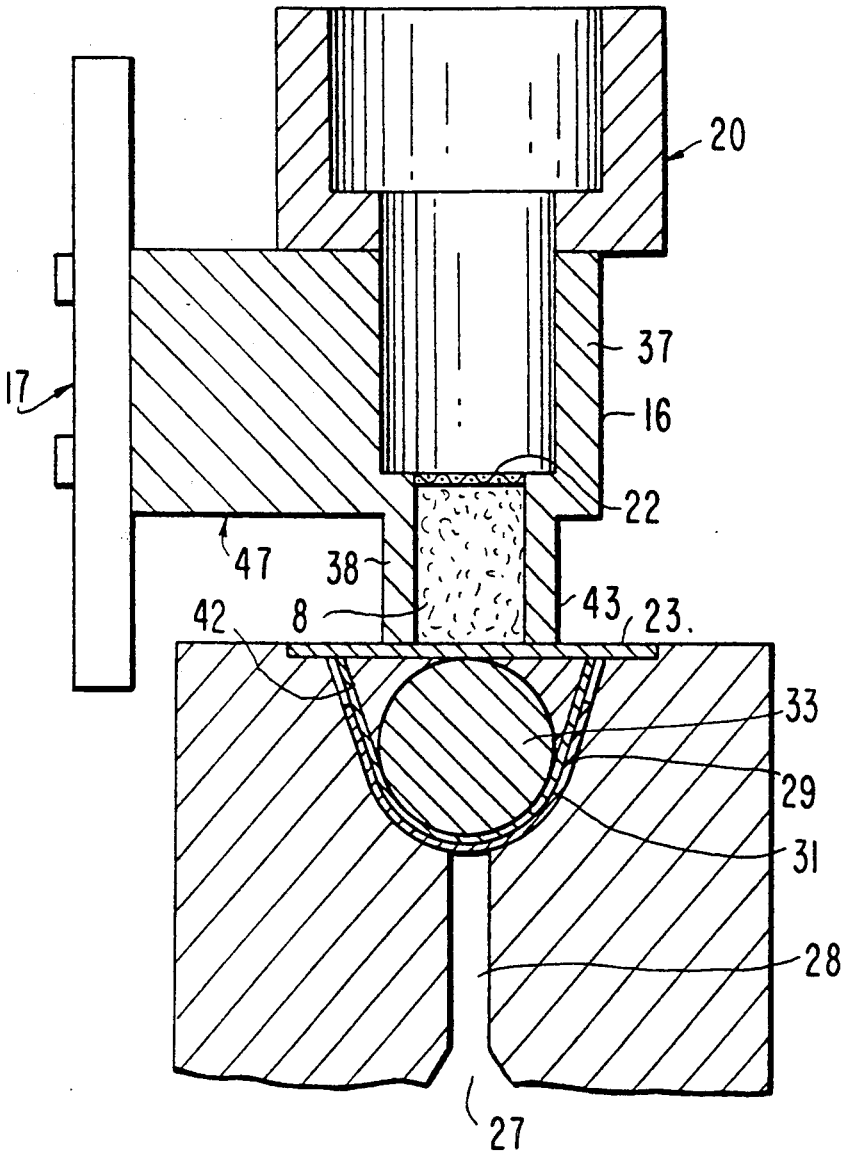
FIG. 9 is a sectional view of the apparatus of FIG. 8, taken from line 3—3 of FIG. 8.
Figure 10:
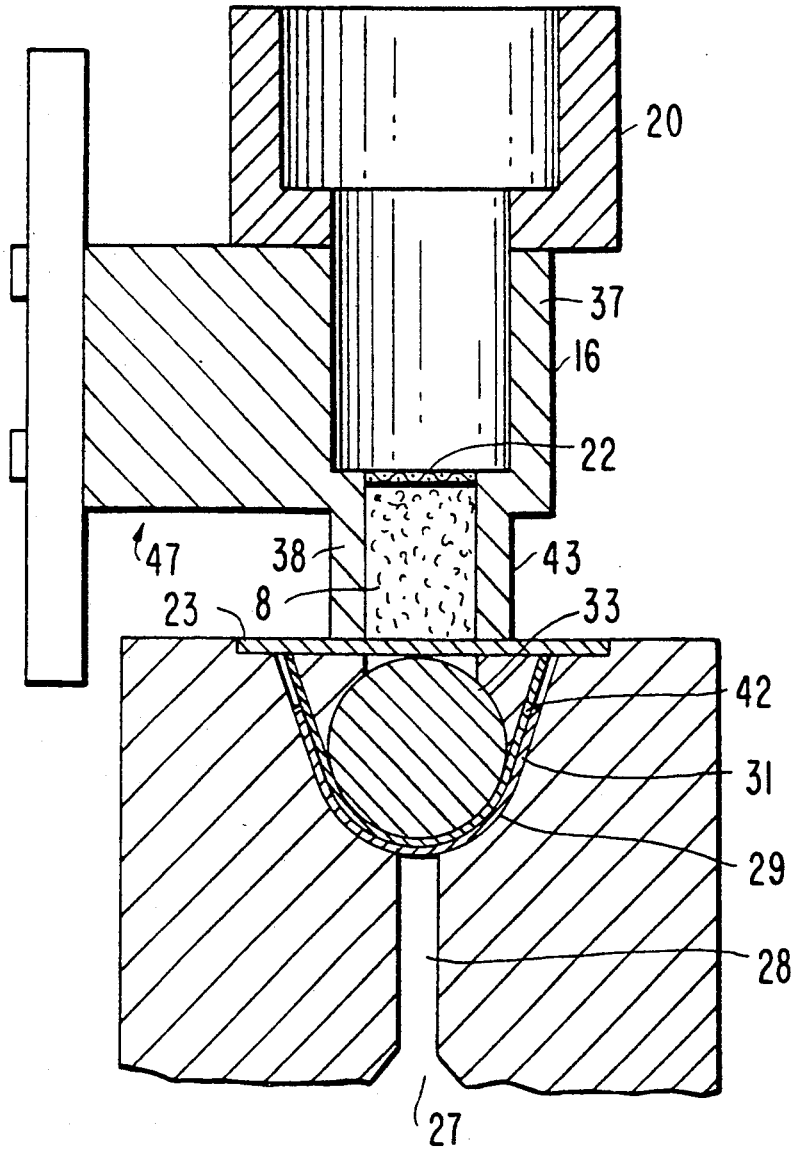
FIG. 10 is an enlarged version of a portion of FIG. 9, also showing a sectional view taken from line 3—3 of FIG. 8.
Figure 11:
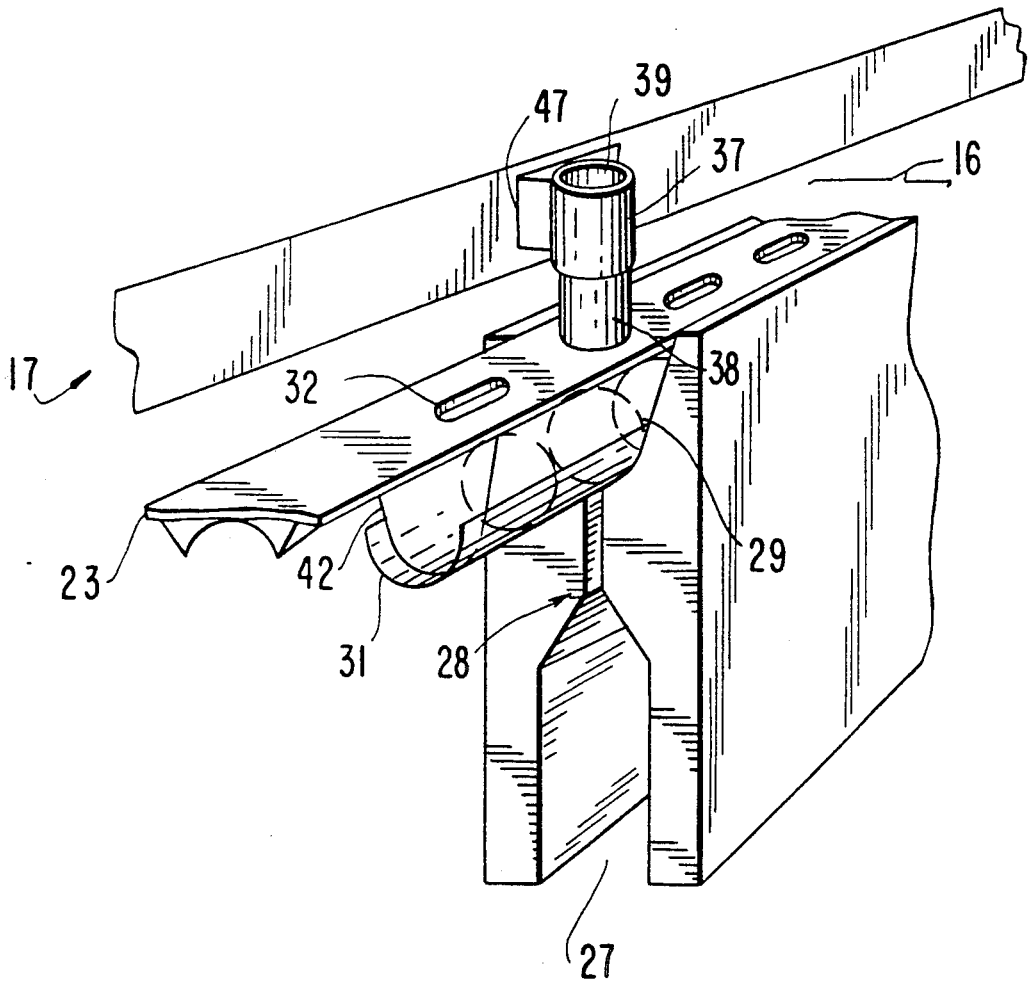
FIG. 11 is a perspective view in fragmentary form of the apparatus of FIGS. 8-10, illustrating the basic relationship between the endless belt, a pocket, the screening belt, the garniture tape, the filter wrap and the garniture.
Figure 12:
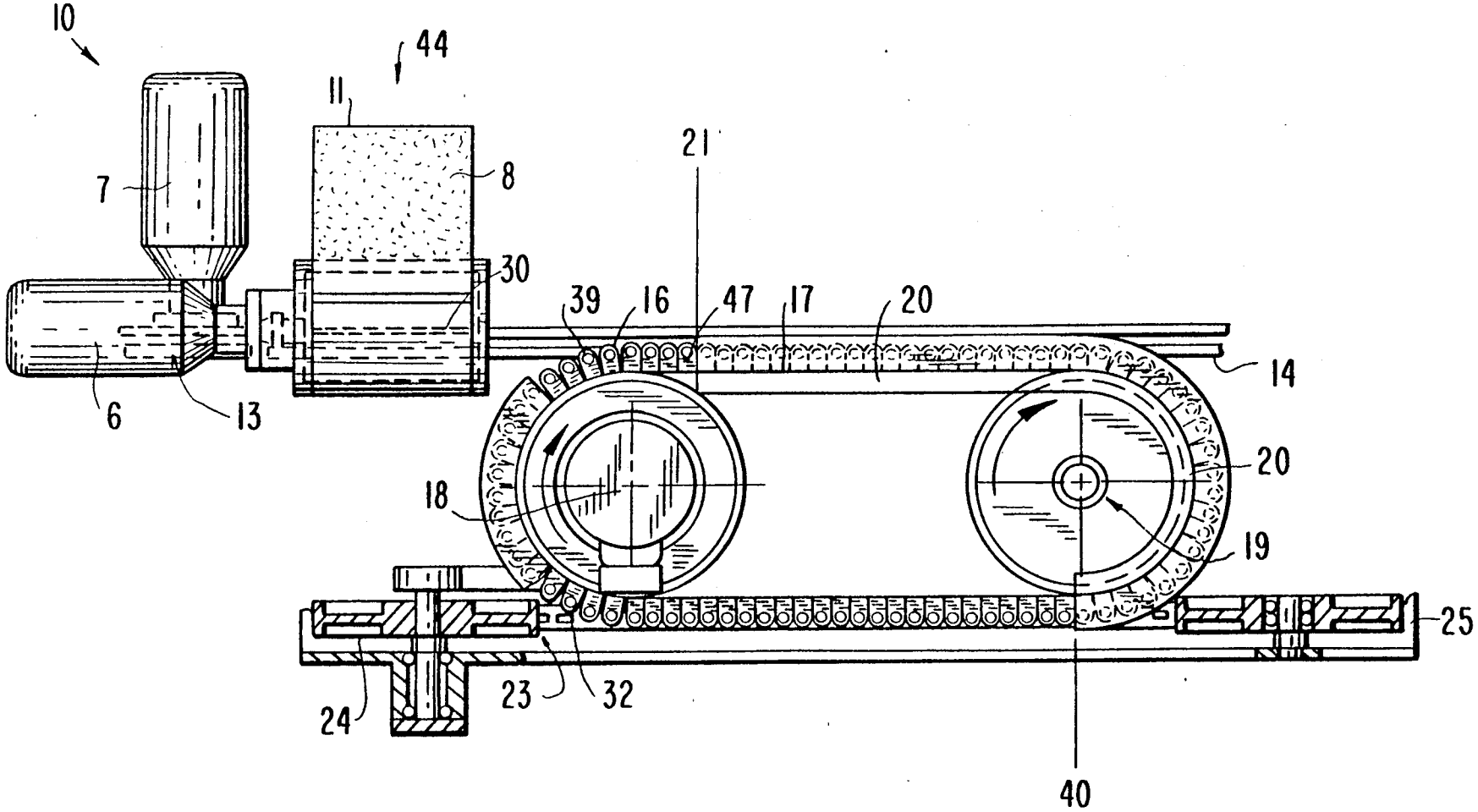
FIG. 12 is a top plan view of the apparatus of FIGS. 8-11, illustrating diagrammatically the basic relationship among the several parts of the apparatus, including the screening belt.

Starting approximately at point 21 of FIG. 1, transport tape 12 conveys the free-flowing material over a course parallel with and underneath a series of moving containers or pockets 16. An individual pocket 16 is represented in FIGS. 6, 7, 9, 10 and 11. FIGS. 4, 5 and 8 each represent a cross-section of a group of pockets and illustrate the relationship of said pockets with other parts of the apparatus.

An aperture 39 perforates each pocket 16. The aperture 39 of each pocket 16 is divided into an upper portion 37 and a lower portion 38 by screen 22 having a suitable mesh size depending on the free-flowing material utilized.

The pockets 16 are individually attached to a continuous or endless belt 17 by a support or stalk 47. Endless belt 17 travels around a plurality of wheels 18 and 19. Said wheels may be aligned and positioned in the horizontal plane in a position approximately perpendicular to wheels 13 and 14. Either or both wheels 18 and 19 may be driven by an electric motor or other suitable method. Wheels 18 and 19 thus function as spaced apart end sprockets providing drive, tension and position for belt 17.

Belt 17 travels a course that eventually becomes parallel with and adjacent to transport tape 12. Belt 17 positions pockets 16 so that the lower portions 38 of pockets 16 travel directly above and proximal to the free-flowing material 8 that is held by vacuum on transport tape 12. During this parallel travel, belt 17 sequentially carries pockets 16 directly over transport tape 12. Simultaneously, transport tape 12 (see FIG. 4) conveys the free-flowing material 8 over a course directly under pockets 16.

The vacuum applied beneath transport tape 12 provided by vacuum chamber 15 ceases at approximately point 21 (see FIG. 1). As the force of the vacuum applied through transport tape 12 ceases, the free-flowing material is no longer held on the surface of transport tape 12. Also at approximately point 21, pockets 16 pass directly over the free-flowing material 8 that is on transport tape 12. Also at point 21, pockets 16 pass under a vacuum hood or chamber 20. Vacuum hood 20 applies vacuum through apertures 39 of pockets 16. This vacuum draws the free-flowing material off transport tape 12 and up into the lower portion 38 of each pocket 16. Screen 22 is permeable enough to allow the pull of vacuum, yet tight enough to prevent passage of free-flowing material 8.

Transport tape 12 may be adjusted to run faster or slower than endless belt 17. An optimal speed differential between transport tape 12 and belt 17 will ensure that the vacuum applied to pockets 16 will draw all, or nearly all, of the free-flowing material 8 off transport tape 12, thereby eliminating the need to refeed or recirculate free-flowing material 8.

Belt 17 then conveys pockets 16, each now retaining a discrete amount of free-flowing material 8, under vacuum hood 20 to approximately point 40 (see FIG. 1). While pockets 16 are traveling under vacuum hood 20, the vacuum holds the free-flowing material 8 in place against screen 22 or pockets 16. At approximately point 40, vacuum hood 20 ends. As belt 17 conveys a pocket 16 beyond vacuum hood 20, and atmospheric pressure or slightly positive pressure is applied to the pocket, the vacuum holding free-flowing material 8 in the pocket 16 ceases. Also at approximately point 40, belt 17 travels parallel with and above garniture tape 31. Without vacuum to hold the free-flowing material 8 against screen 22 in pocket 16, the free-flowing material 8 is released above garniture tape 31.

Garniture tape 31 (see FIGS. 5-7) transports plug wrap 42 through a trough called a garniture 29 where plug wrap 42 assumes a trough shape. A series of filter plugs 33 separated by discrete receiving spaces 26 are axially aligned within trough-shaped plug wrap 42. Plug wrap 42 is turned upward so that it directly touches the sides 43 of the lower portion 38 of pocket 16. Both garniture tape 31 and plug wrap 42 are permeable to air.

An independent electrical or electronic device may be used to directly coordinate the travel of belt 17 with the parallel travel of garniture tape 31 such that apertures 39 of pockets 16 sequentially come into register with discrete receiving spaces 26. Thus, at approximately point 40 where vacuum hood 20 ends and atmospheric or positive pressure is introduced into pockets 16, the free-flowing material 8 is sequentially released from pockets 16 to move toward receiving spaces 26.

A vacuum chamber or plenum 27 located beneath garniture 29 draws a vacuum through vacuum slot 28 located in garniture 29. This vacuum is applied through the air permeable garniture tape 31 and plug wrap 42 transported on garniture tape 31. The vacuum created by vacuum plenum 27 draws a vacuum through garniture tape 31 and plug wrap 42, thus creating a negative pressure in the receiving spaces 26. This negative pressure draws the free-flowing material 8 directly into receiving spaces 26. The negative pressure also acts to retain free-flowing material 8 in the discrete receiving spaces 26.

Following this operation garniture tape 31 moves the partially constructed cigarette filter assemblies to the next step of the cigarette filter assembly process.

The preferred embodiment of the invention that is similar to the above described embodiment is illustrated in FIGS. 8-13. As in the above embodiment, garniture tape 31 transports plug wrap 42 through garniture 29 where plug wrap 42 assumes a trough shape. A series of filter plugs 33 separated by discrete receiving spaces 26 are axially aligned within trough-shaped plug wrap 42. This alternative embodiment includes a screening tape or belt 23 that travels between pockets 16 and filter plugs 33 transported through garniture 29. In this alternative embodiment, the plug wrap 42 does not necessarily touch sides 43 of the lower portion 38 of pocket 16.

Figure 13:
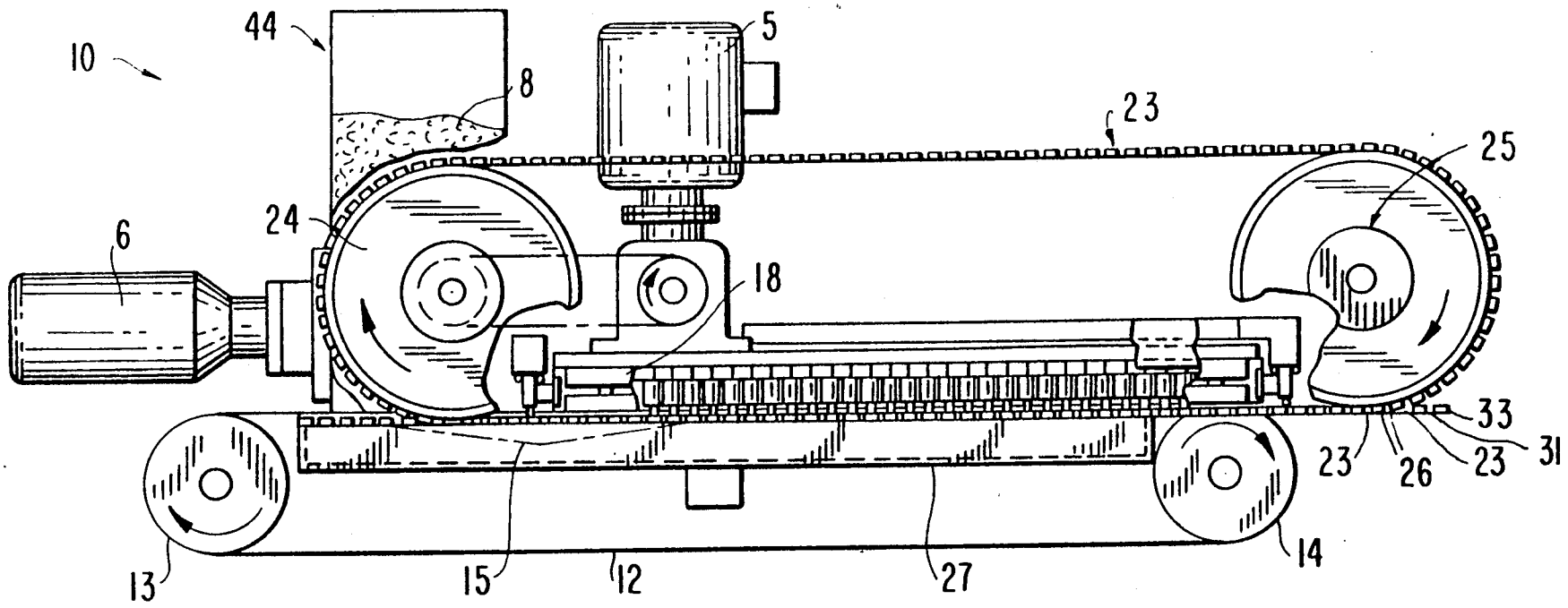
FIG. 13 is a full frontal view of the apparatus of FIGS. 8-12.

Screening tape 23 is an endless tape, travelling around a plurality of wheels 24 and 25 aligned, in sequence and positioned in the vertical plane in a position approximately perpendicular to wheels 18 and 19. Wheels 24 and 25 may be driven by an electric motor 5 as shown or may be driven by other methods. In FIG. 13, motor 5 also serves to drive wheels 18 and 19. Wheels 24 and 25 thus function as spaced apart end sprockets providing drive, tension and position for screening tape 23. Screening tape 23 runs parallel to and directly above garniture tape 31.

Screening tape 23 contains apertures 32. An independent electrical or electronic device may be used to coordinate the travel of belt 17 with the parallel travel of screening tape 23 such that apertures 39 of pockets 16 register with apertures 32 of screening tape 23. Likewise, an independent electrical or electronic device may be used to coordinate the travel of screening tape 23 with the parallel travel of the garniture tape 31. Thus apertures 32 in screening tape 23 directly register with discrete receiving spaces 26, while the non-apertured portion of screening tape 23 masks filter plugs 33.

Thus, as a pocket 16 travels beyond approximately point 40, aperture 39 of pocket 16, an aperture 32 of screening tape 23 and a discrete receiving space 26 between filter plugs 33 will all three come into register. As the vacuum hood 20 ends at approximately point 40, and atmospheric or slightly positive pressure is applied to the pocket 16, the free-flowing material in pocket 16 is free to move through aperture 32 toward discrete receiving spaces 26.

This movement is made more efficient by a vacuum device applied to vacuum chamber or plenum 27 which draws a vacuum through vacuum slot 28 located in garniture 29, through air permeable garniture tape 31 and plug wrap 42. The resulting negative pressure in discrete receiving spaces 26 draws the free-flowing material 8 directly into discrete receiving spaces 26. The negative pressure also acts to retain the free-flowing material 8 in discrete receiving spaces 26.

An alternate embodiment is illustrated in FIGS. 14–17. In this embodiment, transport tape 12 travels around a plurality of wheels 13 and 14 which are located at different levels in a vertical direction so that transport tape 12 travels in a sloping direction between wheels 13 or 14. Transport tape 12 is permeable to air. Vacuum from vacuum plenum 15 beneath transport tape 12 draws through the tape. The vacuum draws the free-flowing material falling from dispensing device 44 onto the surface of transport tape 12 and retains it in place, even as transport tape 12 moves at high speeds.

Figure 14:
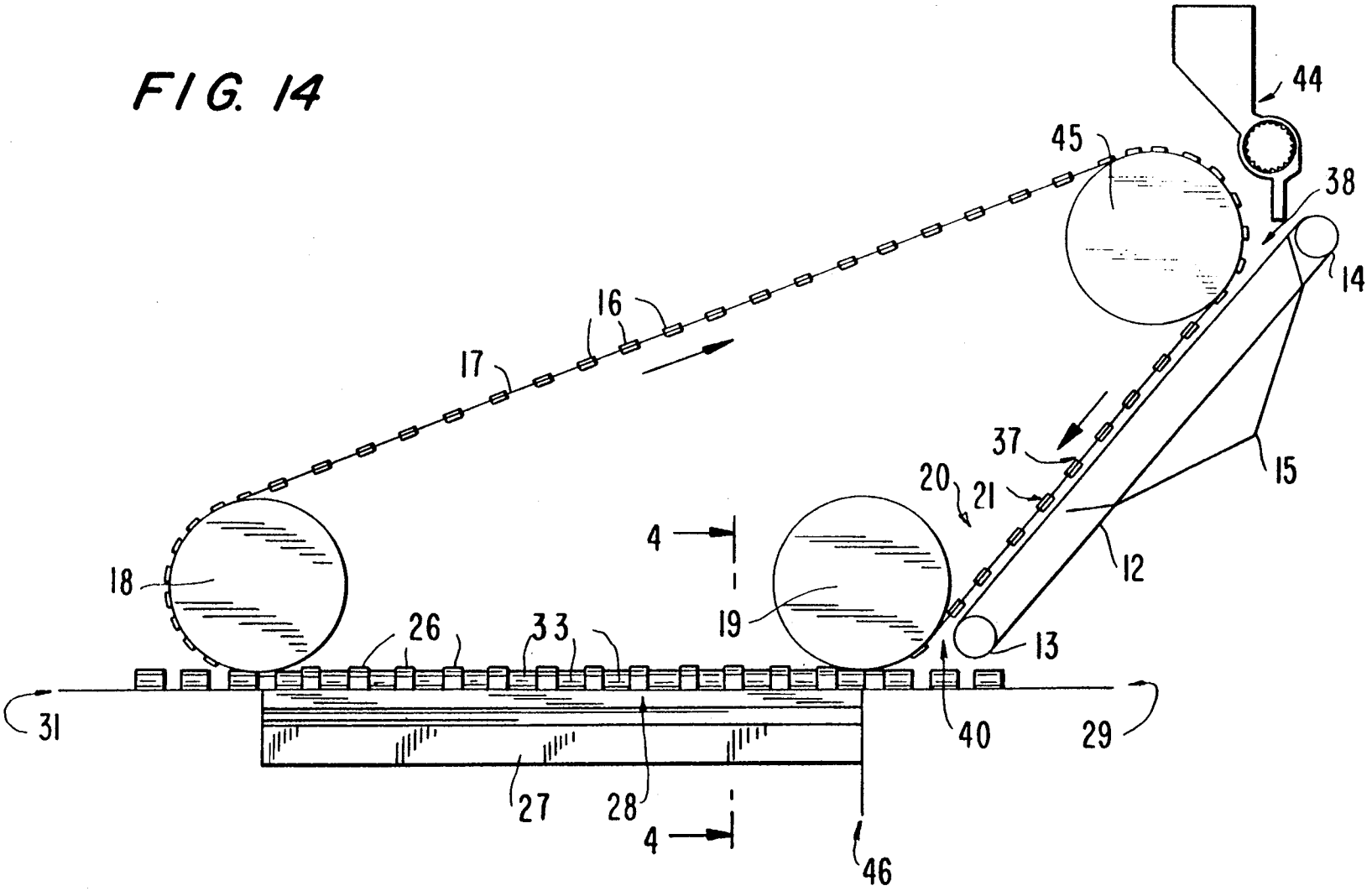
FIG. 14 is a full frontal view of an alternative embodiment of the apparatus of FIG. 1.
Figure 15:
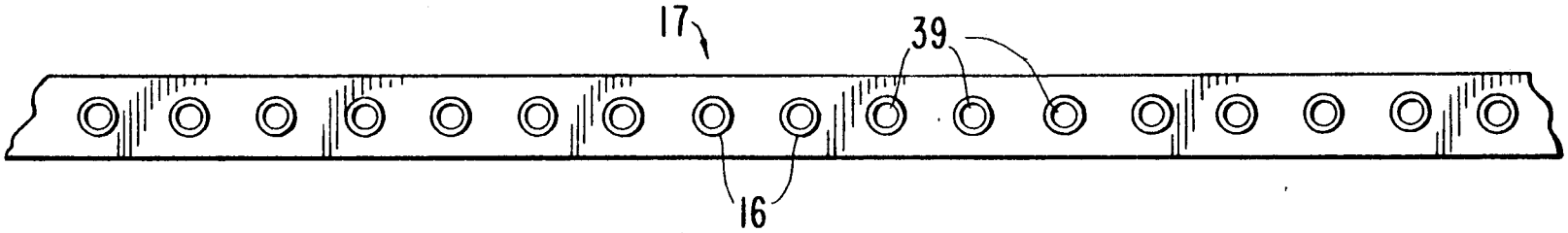
FIG. 15 is a top view of the tape used in the apparatus of FIG. 14, illustrating the basic relationship between the pockets and the endless belt.
Figure 16:
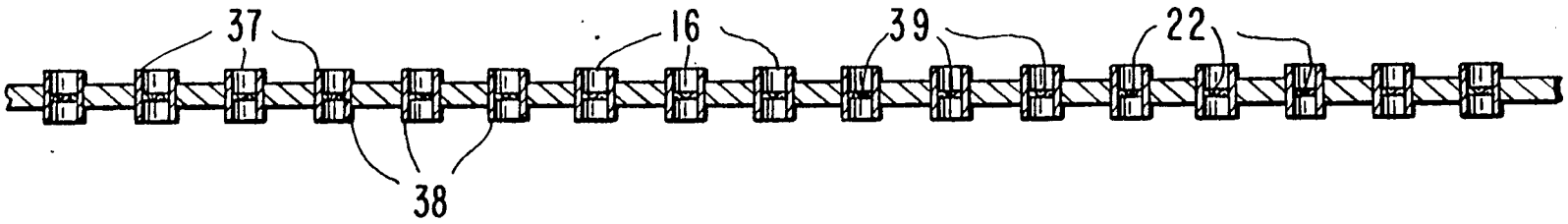
FIG. 16 is a sectional view of a portion of the endless belt of FIG. 13.

In the embodiment of FIGS. 14–17, transport tape 12 conveys the free-flowing material over a path parallel with and underneath a series of pockets 16 that are positioned within endless belt 17, as illustrated in FIGS. 15 and 16. An aperture 39 perforates each pocket 16. Apertures 39 of pockets 16 are divided into an upper portion 37 and a lower portion 38 by screen 22.

Figure 17:
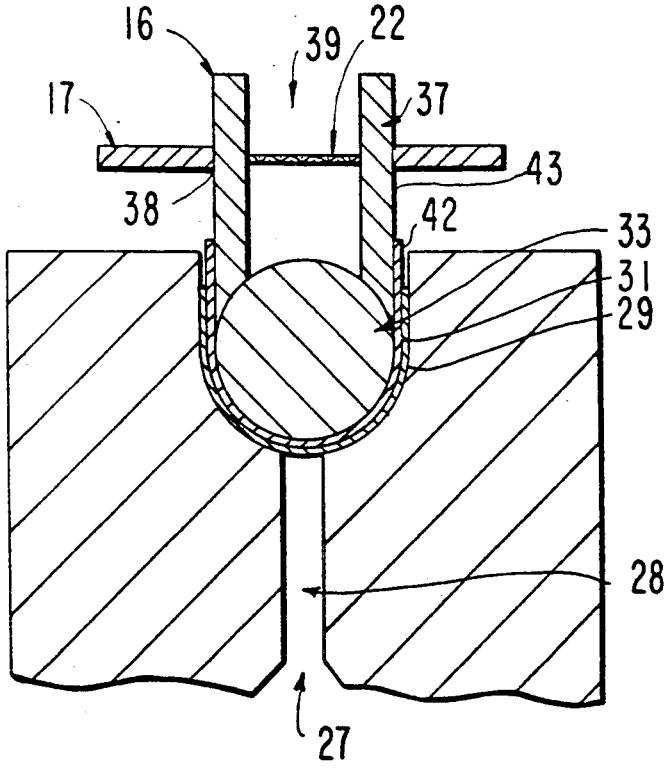
FIG. 17 is a sectional view of the apparatus of FIGS. 14-16, taken from line 4—4 of FIG. 14.

Pockets 16 perforate through and are positioned within belt 17 (see FIGS. 15–17). Belt 17 containing pockets 16, travels around a plurality of wheels 18, 19 and 45. Said wheels are aligned and positioned in the vertical plane positioned to create a triangular course around which belt 17 travels. One or all of wheels 18, 19 and 45 may be driven by an electric motor or by other suitable means. Wheels 18, 19 and 45 thus function as spaced apart end sprockets providing drive, tension and position for belt 17.

Endless belt 17 travels a course in part parallel with and directly above downward sloping transport tape 12. Belt 17 positions pockets 16 so that the lower portions 38 of pockets 16 travel directly above and proximal to the free-flowing material 8 held on transport tape 12 by vacuum. Simultaneously, transport tape 12 conveys the free-flowing material on a path directly under pockets 16.

The effect of the vacuum applied beneath transport tape 12 provided by vacuum chamber or plenum 15 ceases at approximately point 21 (see FIG. 14). As the force of the vacuum applied through transport tape 12 ceases, the free-flowing material 8 is no longer retained on the surface of transport tape 12. Also at approximately point 21, pockets 16 pass directly over the free-flowing material 8 that is on transport tape 12. Also at point 21, pockets 16 pass under a vacuum hood or chamber 20. Vacuum hood 20 applies vacuum through apertures 39 of pockets 16. This vacuum draws the free-flowing material 8 off transport tape 12 and up into the lower portion 38 of pocket 16. Screen 22 is permeable enough to allow the pull of vacuum, yet tight enough to prevent passage of free-flowing material 8.

Transport tape 12 may be adjusted to run faster or slower than endless belt 17. An optimal speed differential between transport tape 12 and belt 17 will ensure that the vacuum applied to pockets 16 will draw all, or nearly all, of the free-flowing material 8 off the tape, thereby eliminating the need to refeed or recirculate free-flowing material 8.

Belt 17 then conveys pockets 16, each retaining a discrete amount of free-flowing material 8, under vacuum hood 20 to approximately point 40. While pockets 16 are traveling under vacuum hood 20, the vacuum holds the free-flowing material 8 in place against screen 22 of pockets 16.

At approximately point 40, vacuum hood 20 ends. Yet vacuum continues to retain the free-flowing material in pockets 16 as belt 17 travels around wheel 19. Wheel 19 blocks apertures 39, thereby preventing atmospheric pressure from relieving the vacuum applied to pockets 16. At approximately point 46, belt 17 travels beyond wheel 19 and apertures 39 are open to atmospheric pressure, relieving the vacuum. Also at approximately point 46, belt 17 travels parallel with and above garniture tape 31. Without vacuum to hold the free-flowing material against screen 22 in pocket 16, the material is released above garniture tape 31.

Garniture tape 31 transports plug wrap 42 through garniture 29 where the plug wrap 42 assumes a trough shape. A series of filter plugs 33 separated by discrete receiving spaces 26 are axially aligned within trough-shaped plug wrap 42. Plug wrap 42 is turned upward so that it directly touches the sides 43 of the lower portion 38 of pockets 16. Both garniture tape 31 and plug wrap 42 are permeable to air.

An independent electrical or electronic device may be used to directly coordinate the travel of belt 17 with the parallel travel of garniture tape 31 such that apertures 39 of pockets 16 sequentially come into register with discrete receiving spaces 26. Thus, at approximately point 46, belt 17 transports pockets 16 beyond wheel 19, and atmospheric or positive pressure relieves the vacuum in pockets 16 thereby sequentially releasing the free-flowing material 8 above receiving spaces 26.

A vacuum chamber or plenum 27 located beneath garniture 29 draws a vacuum through vacuum slot 28 located in garniture 29. This vacuum is applied through the air permeable garniture tape 31 and plug wrap 42 transported on garniture tape 31. The vacuum created by vacuum plenum 27 draws a vacuum through garniture tape 31 and plug wrap 42, thus creating a negative pressure in the receiving spaces 26. This negative pressure draws free-flowing material 8 directly from pockets 16 directly into receiving spaces 26. The negative pressure also acts to retain the free-flowing material 8 in the discrete receiving spaces 26.

For example, one skilled in the art would recognize that if vacuum is not employed to draw the free-flowing material into the receiving space, the travel time for the free-flowing material (e.g., charcoal) could be increased so that gravity alone would be effective.

One skilled in the art will appreciate that the present invention can be practiced by other than the described embodiments, which are presented for purposes of illustration and not of limitation. The present invention is limited only by the claims which follow.

We claim:

1. A method for rapidly feeding a free flowing material into partially constructed cigarette filter assemblies, said method comprising:

a) dispensing free flowing material onto a first conveyance means;

b) applying vacuum to said first conveyance means to draw said free flowing material onto said first conveyance means and to hold said free flowing material thereon;

c) positioning a second conveyance means adapted to hold discrete amounts of free flowing material in proximity to said first conveyance means so that a portion of said second conveyance means travels parallel to and above said first conveyance means;

d) transferring said free flowing material from said first conveyance means to said second conveyance means by applying vacuum to said second conveyance means;

e) applying vacuum to said second conveyance means to hold said free flowing material on said second conveyance means;

f) disposing units of cigarette filter material on a third conveyance means so that said units of cigarette filter material are substantially evenly spaced apart thereby forming discrete receiving spaces between said units of cigarette filter material;

g) positioning said third conveyance means in proximity to said second conveyance means so that a portion of said third conveyance means travels parallel to and beneath said second conveyance means;

h) releasing said free flowing material from said second conveyance means and applying vacuum to said third conveyance means to assist in depositing said free flowing material from said second conveyance means into said receiving spaces.

2. A method according to claim 1 further comprising synchronizing the rates of the travel of said first and second conveyance means so that substantially all of said free flowing material is transferred from said first conveyance means onto said second conveyance means.

3. A method according to claim 1 further comprising synchronizing the rates of the travel of said second and third conveyance means so that substantially all of said free flowing material is accurately deposited in the receiving spaces formed on said third conveyance means.

4. A method according to claim 1 further comprising directing the deposition of free flowing material into said receiving spaces on said third conveyance means and substantially preventing the deposition of said free flowing material onto said units of cigarette filter material using a screening means comprising a series of apertures.

5. A method according to claim 4 further comprising synchronizing the rates of the travel of said screening means and said third conveyance means.

6. A method for rapidly feeding a free flowing material into partially constructed cigarette filter assemblies, said method comprising:

a) dispensing free flowing material onto a first conveyance means;

b) applying vacuum to said first conveyance means to draw said free flowing material onto said first conveyance means and to hold said free flowing material thereon;

c) positioning a second conveyance means adapted to hold discrete amounts of free flowing material in proximity to said first conveyance means so that a portion of said second conveyance means travels parallel to and above said first conveyance means;

d) transferring said free flowing material from said first conveyance means to said second conveyance means by applying vacuum to said second conveyance means;

e) applying vacuum to said second conveyance means to hold said free flowing material on said second conveyance means;

f) disposing units of cigarette filter material on a third conveyance means so that said units of cigarette filter material are substantially evenly spaced apart thereby forming discrete receiving spaces between said units of cigarette filter material;

g) positioning said third conveyance means in proximity to said second conveyance means so that a portion of said third conveyance means travels parallel to and beneath said second conveyance means and releasing said free flowing material from said second conveyance means into said receiving spaces, said releasing of free flowing material being assisted by gravity.

7. A method according to claim 6 further comprising synchronizing the rates of the travel of said first and second conveyance means so that substantially all of said free flowing material is transferred from said first conveyance means onto said second conveyance means.

8. A method according to claim 6 further comprising synchronizing the rates of the travel of said second and third conveyance means so that substantially all of said free flowing material is accurately deposited in the receiving spaces formed on said third conveyance means.

9. A method according to claim 6 further comprising directing the deposition of free flowing material into said receiving spaces on said third conveyance means and substantially preventing the deposition of said free flowing material onto said units of cigarette filter material using a screening means comprising a series of apertures.

10. A method according to claim 9 further comprising synchronizing the rates of the travel of said screening means and said third conveyance means.

11. A method for repetitively dispensing a predetermined amount of free flowing material into receiving spaces formed between spaced apart articles, said method comprising the steps of:

a) continuously moving a stream of free flowing material in a first direction along a first substantially straight path;

b) transporting said spaced apart articles a second path in a second direction;

c) moving a plurality of spaced apart receptacles along an endless path, said endless path including a first endless path portion in proximity to said first path, said receptacle moving step including moving said receptacles along said first endless path portion in said direction of said free flowing material;

d) drawing a portion of said free flowing material into each receptacle by applying a vacuum to each receptacle as each receptacle moves along said first endless path portion;

e) applying vacuum to said receptacles to hole said predetermined amount of free flowing material in said receptacle while moving said receptacles from said first endless path portion;

f) releasing said free flowing material from said receptacles into said spaces formed between said spaced apart articles along said second path; and g) repeating steps (a–f).

12. A method according to claim 11, wherein said receptacle moving step includes moving said receptacles along said first endless path portion a substantially straight and parallel relation to said first path of said free flowing material.

13. A method according to claim 11 wherein said endless path includes a second endless path portion proximate to said second path of said spaced apart articles, said receptacle moving step including the step of moving said receptacles along said second endless path portion in said second direction of said spaced apart articles and in a substantially straight and parallel relation to said second path of of said spaced apart articles.

14. A method according to claim 11 further comprising applying vacuum to said spaces formed between said spaced apart articles along said second path of travel to assist in depositing said free flowing material released from the receptacle into said spaces.

* * * * *